US006896025B2

(12) United States Patent
Urushizaki

(10) Patent No.: US 6,896,025 B2
(45) Date of Patent: May 24, 2005

(54) ADHESIVE TAPE ADHERING DEVICE

(76) Inventor: Sakae Urushizaki, 2-1-1, Nagaranaka, Kita-ku, Osaka-shi, Osaka-fu (JP), 531-0062

( * ) Notice: Subject to any disclaimer, the term of this patent is extended or adjusted under 35 U.S.C. 154(b) by 197 days.

(21) Appl. No.: 10/207,270

(22) Filed: Jul. 30, 2002

(65) Prior Publication Data

US 2003/0024651 A1 Feb. 6, 2003

(30) Foreign Application Priority Data

Jul. 31, 2001 (JP) ..... 2001-232938

(51) Int. Cl.[7] ..... B32B 31/00
(52) U.S. Cl. ..... 156/523; 156/577; 156/579
(58) Field of Search ..... 156/523, 527, 156/574, 577, 579; D19/67, 69, 66; 221/25, 30, 70, 71, 72, 73; 225/10, 16, 39, 43, 46, 51, 67, 68; 242/170, 171, 160.1, 160.3, 160.4, 588.1, 588.3, 588.6, 588

(56) References Cited

U.S. PATENT DOCUMENTS 2,493,737 A * 1/1950 Burns ..... 156/523
4,793,536 A 12/1988 Urushizaki

FOREIGN PATENT DOCUMENTS

JP 0781827 * 3/1995 ..... B65H/35/07

* cited by examiner

*Primary Examiner*—Chris Fiorilla
*Assistant Examiner*—Cheryl N. Hawkins
(74) *Attorney, Agent, or Firm*—Wenderoth, Lind & Ponack, L.L.P.

(57) ABSTRACT

In an adhesive tape adhering device, a small distance is provided between a bottom surface of an outer case and lower end surfaces of a pair of left and right side wall plates. A portion of the bottom surface behind a tape exit opening of the outer case is the same horizontal surface as that of a lower end surface of the side wall plate of the outer case. It is preferable that the pressing roller passes through the tape exit opening by a forward swinging operation of the inner case, and projects from the lower end surface of the side wall plate.

26 Claims, 4 Drawing Sheets

ADHESIVE TAPE ADHERING DEVICE

BACKGROUND OF THE INVENTION

1. Field of the Invention

The present invention relates to adhering means of an adhesive tape, and more particularly, to an adhesive tape adhering device in which a roll-like adhesive tape is mounted into a case, a case bottom portion is pressed against an adherend to adhere the adhesive tape and then, the tape is cut.

2. Description of the Background Art

The present applicant patented and proposed an adhesive tape adhering device capable of adhering and cutting an adhesive tape in Japanese Patent No.2611132 "adhesive tape adhering device". The subject matter of the invention of this patent relates to a horizontal bottom plate is provided at its front portion with an outer case having a tape exit. An inner case is mounted to the outer case such that a lower central portion of the inner case can longitudinally swing around a horizontal axis. One side of the inner case is open. An outer peripheral wall upper portion of the inner case is exposed from the opening of the upper portion of the outer case. Bumps and dips, a projecting piece and a fingertip engaging portion comprising a projection are provided on this portion, an adhesive tape which is wound into a roll-shape such that its adhering surface comes inside is rotatably mounted in a side wall of the inner case, a lower portion of the inner case is an opening having no peripheral wall, the opening is provided at its front end with a pressing roller which supports the adhesive tape and pushes the adhesive tape against the adherend which faces the opening of the horizontal bottom plate, an upper end of the swinging plate interposed between the side wall of the inner case and the outer case is pivotally mounted to the outer case, a cutting blade for the adhesive tape is provided on an upper portion of a lateral supporting piece on a lower end of the swinging plate, the swinging plate and the inner case are associatively moved such that the blade is retreated forward of the pressing roller when the inner case is forwardly inclined, and the blade moves below the lifted pressing roller when the inner case is rearwardly inclined.

In the patented invention, the inner case is mounted in the outer case having the horizontal bottom plate such that the inner case can swing longitudinally, the swinging plate which associatively rotates with the inner case is mounted between the outer case and the inner case, a tip end of the adhesive tape wound into the roll-like shape in the inner case is brought into contact with a lower portion of the pressing roller on the lower portion front end of the inner case through the upper side of the guide roller of the inner case, and the swinging plate is provided at its lower portion with the tape cutting blade.

If the fingertip engaging portion is pushed forward using a finger tip, the inner case is forwardly inclined around a lower end of the inner case, and the pressing roller on the front portion lower end of the inner case pushes the adhesive tape against the adherend. At that time, the swinging plate rotates forward, thereby retreating the blade on the lower end. If the outer case is pulled backward while pressing the same downward in this state, the adhesive tape is adhered to the adherend while being sent from the inner case.

The adhesive tape is adhered to the adherend by the above operation, and when the adhesive tape is adhered through a predetermined length, if the fingertip engaging portion on the upper portion of the inner case is pulled backward, the pressing roller is moved upward, the swinging plate is rotated backward, the blade on the lower end is moved below the pressing roller, and the blade cuts the adhesive tape below the pressing roller.

The above conventional device is extremely convenient because the adhesive tape can be adhered and cut continuously. However, since the outer case bottom surface is horizontal from its front portion to its rear portion, the adhering device cannot stably move straight for the adhering operation. Further, since the outer peripheral surface lower portion of the pressing roller coincides with the outer case bottom surface, there is an adverse possibility that the adhering operation can not be carried radially out if there are small bumps and dips on the adherend surface or if the pressing roller is worn, or due to assembling precision of the adhering device.

SUMMARY OF THE INVENTION

In view of the above circumstances, it is an object of the present invention to provide an adhesive tape adhering device which is improved so that the adhering device can easily move straight, and a reliable adhering operation can be carried out.

In view of the above circumstances, the present inventor studied hard and as a result, the inventor solved the above problem.

(1) An adhesive tape adhering device in which an adhesive tape is discharged from a casing lower bottom surface opening, wherein straight lower end edges of a pair of left and right outer case side wall plates extend through a small distance from the casing lower bottom surface.

(2) An adhesive tape adhering device in which an adhesive tape is discharged from a casing lower bottom surface opening, wherein straight lower end edges of a pair of left and right outer case side wall plates extend through 0.1 to 1.0 mm from the casing lower bottom surface.

(3) An adhesive tape adhering device comprising an outer case provided at its bottom surface with a tape exit opening, a pair of left and right side wall plates, an inner case mounted such that the inner case can longitudinally swing around an inner case rotation shaft fixed to a lower portion of the outer case, the inner case having a tape mounting shaft to which a roll-like adhesive tape can be mounted, and an inner case side wall of the inner case, a pressing roller mounted to a front lower tip end of the inner case side wall at right angles, and a guide roller mounted to the inner case side wall on the side of the adhering surface of the adhesive tape for guiding the adhesive tape sent from the roll-like adhesive tape to the pressing roller, wherein there is a small distance between the bottom surface of the outer case and a lower end surface of the side wall (end surface of a straight lower end edge).

(4) An adhesive tape adhering device according to (3), wherein a portion of the bottom surface behind the tape exit opening of the outer case is the same horizontal surface as that of the lower end surface (end surface of a straight lower end edge) of the side wall plate of the outer case.

(5) An adhesive tape adhering device according to (3) or (4), wherein the pressing roller passes through the tape exit opening by forward swinging operation of the inner case, and projects from the lower end surface (end surface of the straight lower end edge) of the side wall plate.

(6) An adhesive tape adhering device according to any one of (3) to (5), wherein the inner case is provided at its front upper portion with a fingertip engaging portion.

(7) An adhesive tape adhering device according to any one of (3) to (6), wherein the outer case and the outer case are engaged with each other between a stopper disposed on a bottom surface in the outer case and a stopper disposed on a rear upper portion of the inner case side wall by means of a plate-like or coil-like spring.

(8) An adhesive tape adhering device according to any one of claims (3) to (7), further comprising a rod-like tape core cylinder retaining member which is fixed to a central portion of the side wall plate of the outer case at right angles and which passes through an oval cam hole formed in the inner case, wherein the tape core cylinder retaining member pushes an adhesive tape core cylindrical inner surface by rearward swinging operation of the inner case caused by stress of the spring.

(9) An adhesive tape adhering device according to any one of (3) to (8), further comprising a side wall plate of the outer case and a swinging plate between the inner case side walls, wherein the swinging plate is pivotally mounted to a swinging plate shaft fixed to the inner case side wall above the swinging plate, a pin fixed to a rear portion of the swinging plate shaft above the inner case side wall is engaged with a cam hole formed in the swing plate, a lateral supporting piece at a lower end of the swinging plate is provided with a cutting blade of the adhesive tape, the swinging plate and the inner case side wall are associatively moved such that the cutting blade is retreated forward of the pressing roller when the inner case is forwardly inclined by the longitudinal swinging operation of the fingertip engaging portion, and the cutting blade moves below the lifted pressing roller when the inner case is rearwardly inclined.

(10) An adhesive tape adhering device according to any one of (3) to (9), wherein the outer case has one open end and the other end which can be attached and detached.

Figure 1:
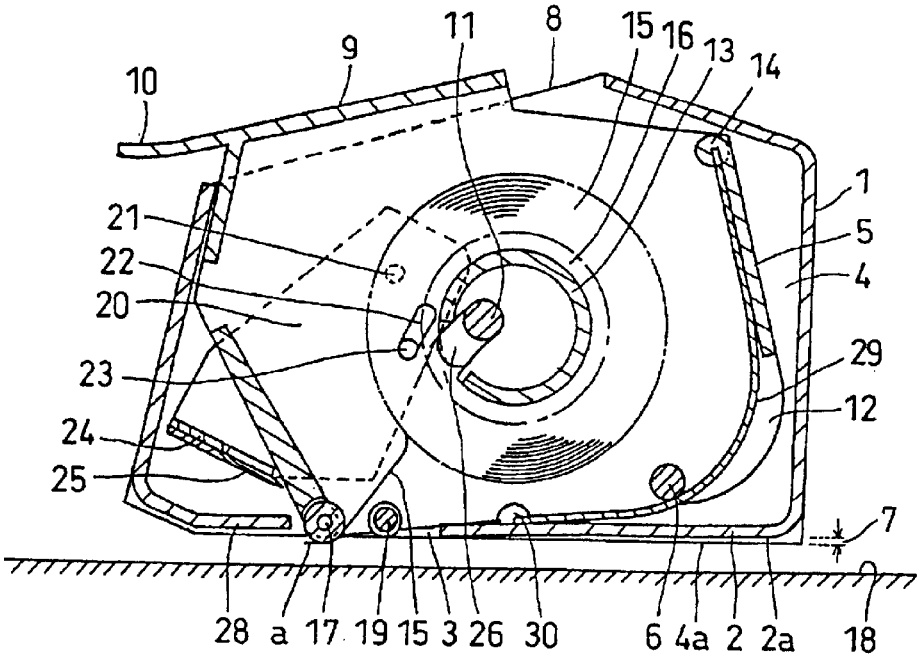
FIG. 1 shows a front sectional view of an adhesive tape adhering device immediately before adhering operation of an embodiment of the present invention in which an inner case is forwardly inclined.

In the present invention, in an adhesive tape adhering device in which an adhesive tape is discharged from a casing lower bottom surface opening, straight lower end edges of a pair of left and right outer case side plates extend through a slight distance (e.g., 0.1 to 2.0 mm, preferably 0.3 to 0.8 mm). Therefore, an edge surface of a straight lower end edge of each of the pair of left and right side wall plates functions as a guide, and it is possible to easily move the adhesive tape adhering device straight to a surface of the adherend without deviating laterally for an adhering operation.

The invention provides an adhesive tape adhering device comprising an outer case provided at its bottom surface with a tape exit opening, a pair of left and right side wall plates, an inner case mounted such that the inner case can longitudinally swing around an inner case rotation shaft fixed to a lower portion of the outer case, the inner case having a tape mounting shaft to which a roll-like adhesive tape can be mounted, and an inner case side wall of the inner case, a pressing roller mounted to a front lower tip end of the inner case side wall at right angles, and a guide roller mounted to the inner case side wall on the side of the adhering surface of the adhesive tape for guiding the adhesive tape sent from the roll-like adhesive tape to the pressing roller, wherein there is a small distance between the bottom surface of the outer case and a lower end surface of the side wall. Therefore, both the surfaces of the lower end surfaces of the pair of left and right side wall plates function as the guides, and even if there are small bumps and dips on the surface of the adherend, it is possible to easily move the adhesive tape adhering device straight without deviating laterally, and to adhere the tape.

Further, a portion of the bottom surface behind the tape exit opening of the outer case is the same horizontal surface as that of the lower end surface of the side wall plate of the outer case. A surface of the adherend is pressed by the horizontal surface, the pressing roller passes through the tape exit opening by swinging operation of the inner case forward, the pressing roller projects from the lower end surface of the side wall plate, and the adhering operation can be carried out while pressing the adhesive tape against the adherend by the pressing roller.

It is preferable that the inner case is provided at its front upper portion with a fingertip engaging portion, the inner case can be swung in the longitudinal direction by the fingertip engaging portion, a plate-like or coil-like spring is provided between a stopper disposed on the bottom surface in the outer case and a stopper disposed on a rear upper portion of the inner case side wall, so that the inner case is automatically returned when the adhering operation is completed.

Further, the adhesive tape adhering device further comprises a rod-like tape core cylinder retaining member which is fixed to a central portion of the side wall plate of the outer case at right angles and which passes through an oval cam hole formed in the inner case, wherein the tape core cylinder retaining member pushes an adhesive tape core cylindrical inner surface by rearward swinging operation of the inner case caused by stress of the spring. When this device is not used, the adhesive tape is not rotated unintentionally.

Further, the adhesive tape adhering device further comprises a side wall plate of the outer case and a swinging plate between the inner case side walls, wherein the swinging plate is pivotally mounted to a swinging plate shaft fixed to the inner case side wall above the swinging plate, a pin fixed to a rear portion of the swinging plate shaft above the inner case side wall is engaged with a cam hole formed in the swing plate, a lateral supporting piece at a lower end of the swinging plate is provided with a cutting blade of the adhesive tape, the swinging plate and the inner case side wall are associatively moved such that the cutting blade is retreated forward of the pressing roller when the inner case is forwardly inclined by the longitudinal swinging operation of the fingertip engaging portion, and the cutting blade moves below the lifted pressing roller when the inner case is rearwardly inclined. Therefore, the adhesive tape can be cut.

DESCRIPTION OF THE PREFERRED EMBODIMENTS

Embodiments

An embodiment of the present invention will be explained.

Figure 2:
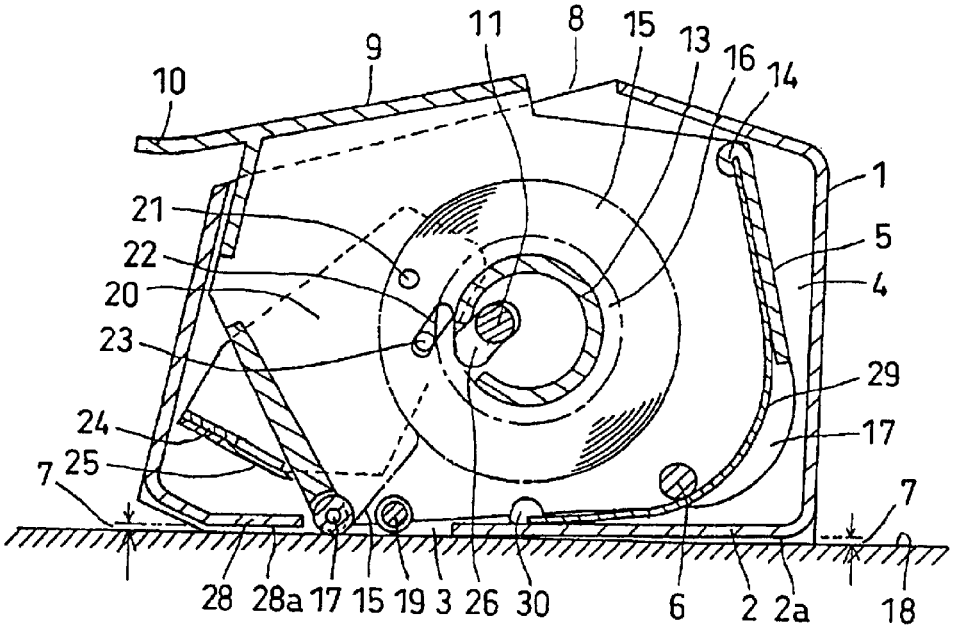
FIG. 2 shows a front sectional view of the adhesive tape adhering device when the adhering operation of the embodiment is started.
Figure 3:
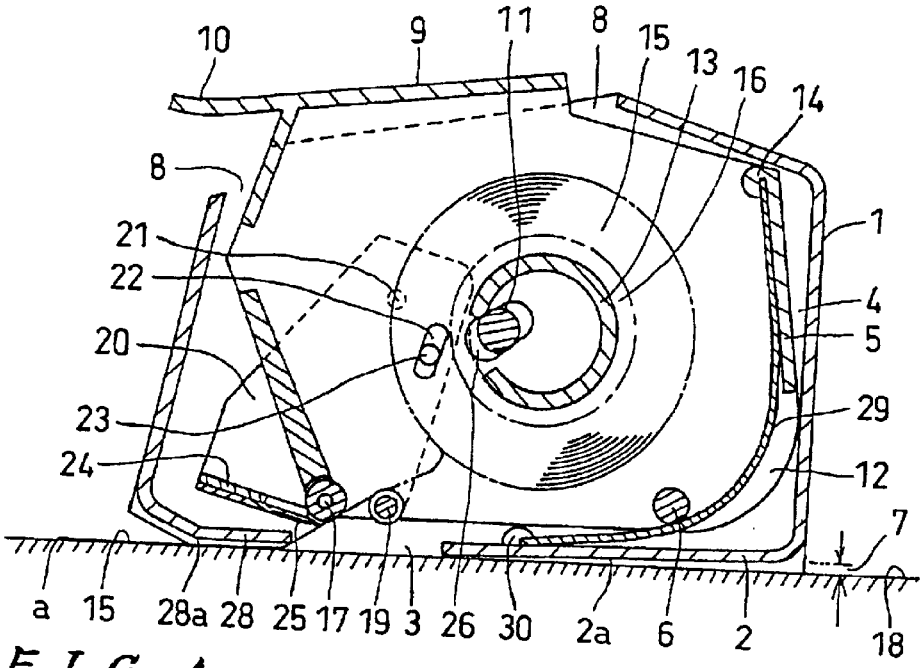
FIG. 3 shows a front sectional view of the adhesive tape adhering device immediately before the cutting operation of the adhesive tape by a cutting blade is started in which the inner case of the embodiment is slightly returned by a stress of a leaf spring.
Figure 4:
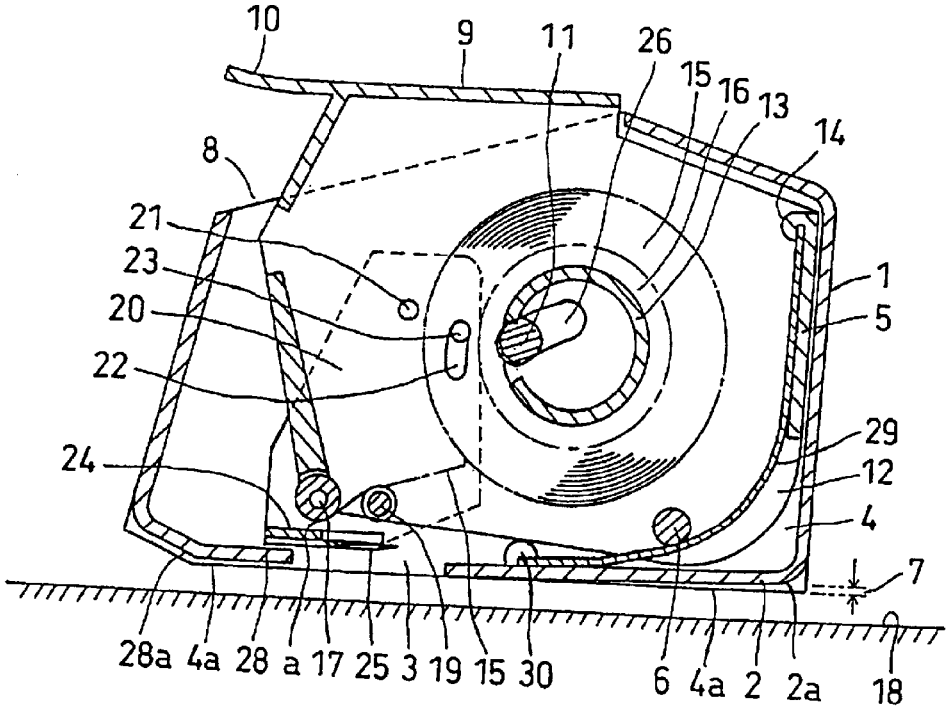
FIG. 4 shows a front sectional view of the adhesive tape adhering device in which the inner case of the embodiment is completely returned rearward by the stress of the leaf spring and the cutting blade is moved below the pressing roller.
Figure 5:
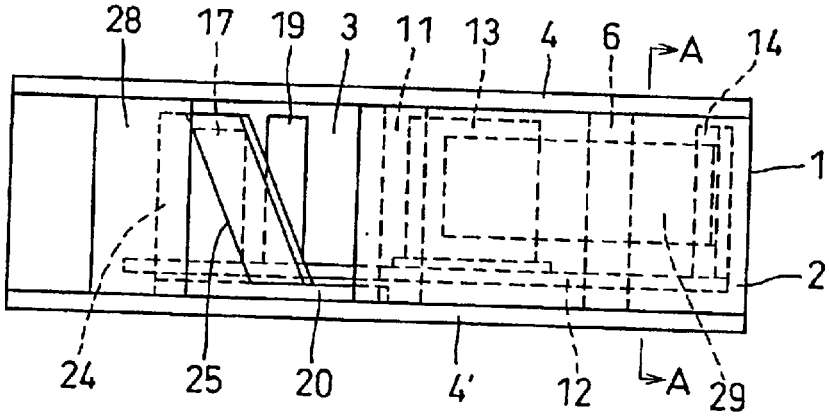
FIG. 5 shows a bottom view of the adhesive tape adhering device of the embodiment.
Figure 6:
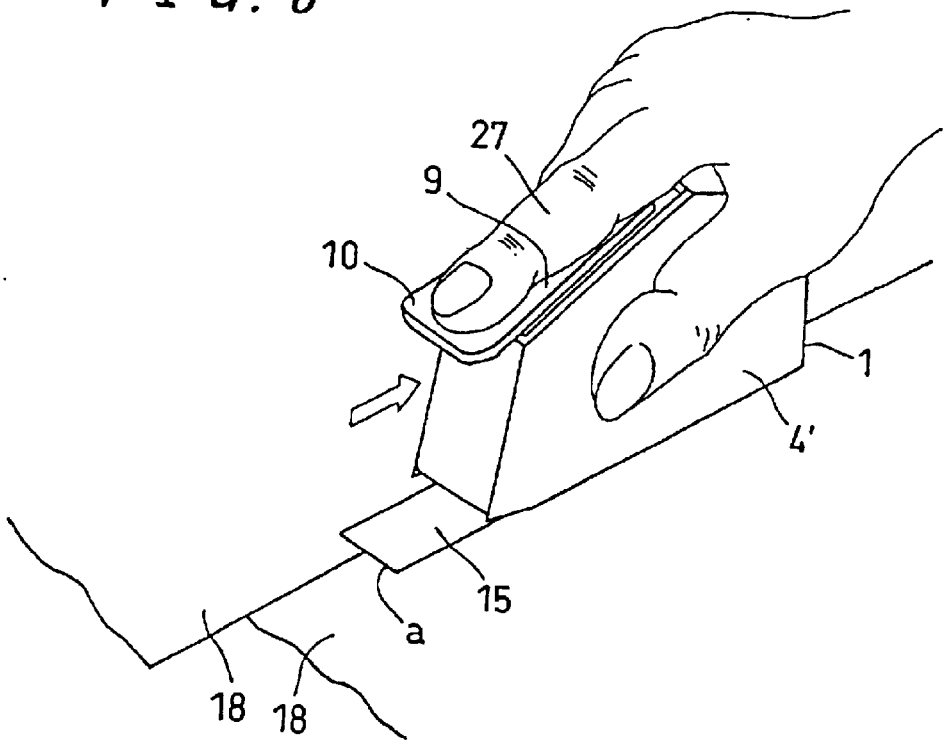
FIG. 6 shows an explanatory view of use of the adhesive tape adhering device of the embodiment.

FIG. 1 is a front sectional view of an adhesive tape adhering device immediately before an adhering operation in which an inner case is inclined forward according to an embodiment of the present invention. FIG. 2 is a front sectional view of the adhesive tape adhering device when adhering operation of this embodiment is started. FIG. 3 is a front sectional view of the adhesive tape adhering device immediately before the inner case of the embodiment is slightly returned by stress of a leaf spring rearwardly and the adhesive tape is cut by the cutting blade. FIG. 4 is a front sectional view of the adhesive tape adhering device in which the inner case of the embodiment is completely returned by the stress of the leaf spring rearwardly and the cutting blade moves to a lower portion of the pressing roller. FIG. 5 is a bottom view of the adhesive tape adhering device of the embodiment. FIG. 6 is an explanatory view of an example of use of the adhesive tape adhering device of the embodiment.

Figure 7:
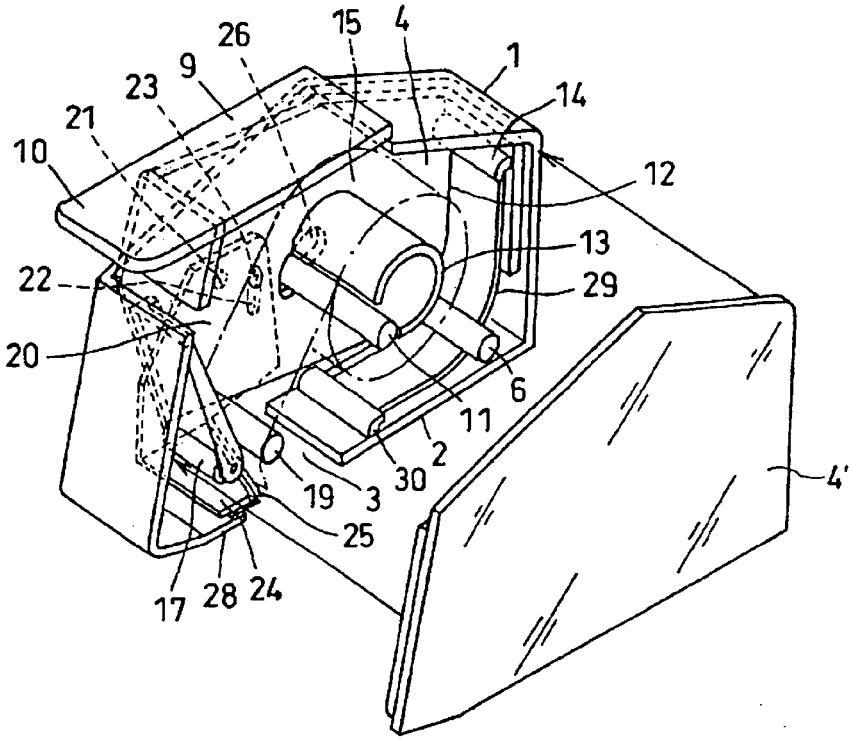
FIG. 7 shows a partial exploded perspective view of the adhesive tape adhering device of the embodiment.
Figure 8A:
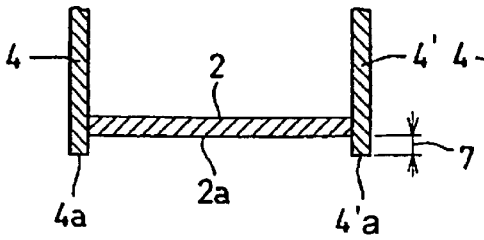
FIGS. 8(*a*) and 8(*b*) show partial sectional views taken along an arrow A—A in FIG. 5.
Figure 8B:
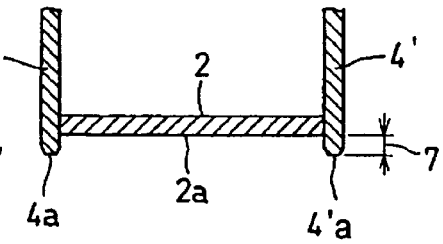

FIG. 7 is a partial exploded perspective view of the adhesive tape of the embodiment. FIGS. 8(*a*) and 8(*b*) are partial sectional views taken along a line A—A in FIG. 5.

In the drawings, a reference number 1 represents an outer case, a reference number 2 represents a tapered bottom plate, a reference number 2*a* represents a bottom surface of the outer case, a reference number 3 represents a tape exit opening, reference numbers 4, 4' represent side wall plates, reference numbers 4*a*, 4'*a* represent lower end surfaces of straight lower end edges of a pair of left and right side wall plates, a reference number 5 represents an inner case, a reference number 6 represents an inner case rotation shaft, a reference number 7 represents a slight distance provided between lower end surfaces 4*a*, 4'*a* of straight lower end edges of the pair of left and right side wall plates 4, 4' and bottom surfaces 2*a*, 28*a* of the outer case, a reference number 8 represents an upper opening, a reference number 9 represents a fingertip engaging portion, a reference number 10 represents a projecting piece, a reference number 11 represents a tape core cylinder retaining member, a reference number 12 represents an inner case side wall, a reference number 13 represents a tape mounting shaft, a reference number 14 represents a stopper, a reference number 15 represents an adhesive tape, a reference number 16 represents a tape core cylinder, a reference number 17 represents a pressing roller, a reference number 18 represents an adherend, a reference number 19 represents a guide roller, a reference number 20 represents a swinging plate, a reference number 21 represents a swinging plate shaft, a reference number 22 represents a cam hole, a reference number 23 represents a pin, a reference number 24 represents a supporting piece, a reference number 25 represents a cutting blade, a reference number 26 represents a cam hole, a reference number 27 a man's hand, a reference number 28 represents a front bottom plate, a reference number 28*a* represents a bottom surface of the outer case, a reference number 29 represents a leaf spring, a reference number 30 represents a stopper, and a reference symbol a represents a tip end of the adhesive tape 15.

In FIGS. 1 to 5, the outer case 1 is provided with side wall plates 4(4') whose one side is open, and a bottom surface thereof is provided with the tape exit opening 3 and the opening 8 above the tape exit opening 3.

The inner case 5 and the inner case side wall 12 whose one side is open are mounted such that they can longitudinally swing around the rotation shaft 6 of the inner case fixed to a rear lower portion of the outer case 1.

The inner case 5 comprises the fingertip engaging portion 9 provided on a front upper portion of the inner case side wall 12, the projecting piece 10 provided on a tip end of the inner case side wall 12, the tape mounting shaft 13 in which the roll-like adhesive tape 15 can be mounted to a substantially central portion of the inner case side wall 12, the pressing roller 17 mounted to a front bottom tip end of the inner case side wall 12 at right angles, and the guide roller 19 mounted to the inner case side wall 12 on an adhering surface of the adhesive tape 15 at the rear of the pressing roller 17 for guiding the adhesive tape 15 sent from the roll-like adhesive tape 15 toward the pressing roller 17.

The inner case 5 can swing longitudinally by the fingertip engaging portion 9. The inner case 5 includes the stopper 14 which can be swung by the fingertip engaging portion 9 and disposed on the bottom surface in the outer case 1. The inner case 5 automatically returns rearward when the adhering operation is completed.

If the inner case 5 automatically returns rearward, it is fixed to a central portion of the side wall plate 4(4') of the outer case 1 at right angles, and the rod-like tape core cylinder retaining member 11 passing through the oval cam hole 26 of the inner case 5 pushes an inner surface of the adhesive tape core cylinder 16 by the rearward swinging operation of the inner case 5 by the stress of the leaf spring 29.

Further, there is provided the swinging plate 20 between the side wall plate 4(4') of the outer case 1 and the inner case side wall 12, the swinging plate 20 is pivotally supported by the swinging plate shaft 21 fixed to the inner case side wall 12, the pin 23 fixed to an upper portion of the inner case side wall 12 and in rear of the swinging plate shaft 21 is engaged with the cam hole 22 disposed in the swinging plate 20, a cutting blade 25 of the adhesive tape 15 is provided on a lower end of the swinging plate 20 and on the supporting piece 24, the cutting blade 25 is retreated forward of the pressing roller 17 when the inner case 5 is forwardly inclined by the longitudinal swinging operation of the fingertip engaging portion 9, and the swinging plate 20 and the inner case side wall 12 are associatively moved so that the cutting blade 25 moves below the pressing roller 17 when the inner case 5 is inclined rearwardly.

In FIG. 1, the roll-like adhesive tape 15 is mounted to the tape mounting shaft 13, and the adhesive tape tip end a is pulled out. The projecting piece 10 on the tip end of the fingertip engaging portion 9 is pushed and the adhesive tape tip end a is allowed to pass through an upper portion of the guide roller 19 and then, is pulled out to an outer peripheral lower portion of the pressing roller 17.

To start the adhering operation, a rear portion lower side angle of the outer case 1 is brought into contact with the adherend, and a front lower end surface of the side wall plate 4(4') of the outer case 1 is pushed against the adherend 18.

In FIG. 2, if the outer case 1 is moved rearwardly while pushing the fingertip engaging portion 9 and the projecting piece 10, the adhesive tape 15 is pushed by the pressing roller 17 and is reliably adhered by the adherend 18.

The front portion of the tapered bottom plate 2 of the outer case 1 is on the lower end surface of the side wall plate 4 (4') and the horizontal surface. Therefore, the surface of the adherend 18 is previously pushed, and the adhering operation can be carried out more reliably.

In FIG. 3, if the adhering operation of the adhesive tape 15 having the predetermined length is completed, the pushing force of the projecting piece 10 is released, and if the inner case 5 is inclined rearwardly by the stress of the leaf spring 29, the cutting blade 25 and the supporting piece 24 mounted to the tip end of the swinging plate 20 which rotates in association with the inner case 5 move below the lifted pressing roller 17, and the cutting operation of the adhesive tape 15 is started.

In FIG. 4, if the cutting operation of the adhesive tape 15 is completed and the front portion of the outer case 1 is lifted, the supporting piece 24 and the cutting blade 25 moved below the pressing roller, the adhesive tape 15 gets ready for the next adhering operation while leaving the adhesive tape tip end a on an outer peripheral surface lower portion of the pressing roller 17 in a state in which the adhesive tape 15 is adhered to the guide roller 19.

At the same time, the tape core cylinder retaining member 11 pushes an inner surface of the adhesive tape core cylinder 16 by the rearward swinging operation of the inner case 5 by the stress of the leaf spring 29, and idling caused by vibration of the roll-like adhesive tape 15 is prevented.

In FIG. 5, a blade tip of the cutting blade 25 fixed to the supporting piece 24 is inclined as shown in FIG. 5, and therefore, it is possible to cut the adhesive tape 15 from its end easily.

In FIG. 6, the projecting piece 10 which is formed such as to warp upward by its front end together with the fingertip engaging portion 9 on a front upper portion of the inner case 5 is fit to the man's hand 27. A surface on which the man's hand is placed may be provided with bumps and dips so that the surface is not slippery.

In FIG. 7, one side of the outer case 1 is open, and the side wall plate 4' can be attached and detached by engaging means (not shown).

In FIGS. 8(*a*) and 8(*b*), the reference number 7 represents the small distance which is provided between the lower end surfaces 4*a*, 4'*a* of the straight lower edges of the pair of left and right side wall plates 4, 4' and the bottom surfaces 2*a* (28*a*) of the outer case. Because the small distance 7 is interposed, the lower end surfaces 4*a*, 4'*a* of the straight lower edges of the pair of left and right side wall plates 4, 4' function as rail-like guides, the adhesive tape adhering device can easily move straightly on the surface of the adherend 18 without deviating laterally, and it is possible to straightly adhere the adhesive tape 15. In FIG. 8(*a*), the lower end surfaces 4*a*, 4'*a* of the side wall plates 4, 4' are flat and stable. In FIG. 8(*b*), the lower end surfaces 4*a*, 4'*a* are largely chamfered, and the lower end surfaces 4*a*, 4'*a* become thin, and the surfaces function as the rail-like guide and lateral slip is less prone to be generated.

According to the present invention, the following effects can be exhibited.

An edge surface of the straight lower end edge of each of the pair of left and right side wall plates functions as the guide, the adhesive tape adhering device is allowed to easily move straightly on the surface of the adherend without deviating laterally, and it is possible to easily adhere the adhesive tape straightly.

The portion of the rear bottom surface of the tape exit opening of the outer case is the same horizontal surface as that of the lower end surface of the side wall plate of the outer case. Therefore, the adherend immediately before it is adhered by the pressing roller can be held flat, and it is possible to reliably adhere the tape.

The pressing roller passes through the tape exit opening by the forward swinging operation of the inner case, and the pressing roller projects from the lower end surface of the side wall plate. Therefore, the pressing roller can directly push the adherend and reliably adhere the tape.

Since the inner case is provided at its front upper portion with the fingertip engaging portion, it is easily fit to the man's hand and the adhering operation becomes easy.

The outer case and the inner case are engaged with the plate-like or coil-like spring between the stopper disposed on the bottom surface in the outer case and the stopper disposed on a rear and upper portion of the inner case side wall. Therefore, if the man's hand is relaxed when the adhering operation is completed, the inner case is automatically inclined rearwardly, and the adhesive tape can be cut at the same time.

The tape core cylinder retaining member pushes the adhesive tape core cylindrical surface by the rearward swinging operation of the inner case by the stress of the spring, and therefore, the idling which may be caused by vibration or the like of the roll-like adhesive tape can be prevented when it is not used.

Since the swinging plate and the inner case side wall are associatively moved, the cutting blade draws a substantially horizontal arc and cuts the adhesive tape by slight swinging operation of the inner case, and excellent cutting sharpness can be obtained.

Since one side of the outer case is open, and the other side wall of the outer case is detachable, it is easy to attach and detach the roll-like adhesive tape.

What is claimed is:

1. An adhesive tape adhering device comprising an outer case provided at its bottom surface with a tape exit opening, a pair of left and right side wall plates, an inner case mounted such that the inner case can longitudinally swing around an inner case rotation shaft fixed to a lower portion of the outer case, the inner case having a tape mounting shaft to which a roll of adhesive tape can be mounted, and an inner case side wall of the inner case, a pressing roller mounted to a front lower tip end of the inner case side wall at right angles, and a guide roller mounted to the inner case side wall on the side of the adhering surface of the adhesive tape for guiding the adhesive tape sent from the roll of adhesive tape to the pressing roller, wherein there is a small distance between the bottom surface of the outer case and a lower end surface of one of the side wall plates, and wherein a portion of the bottom surface behind the tape exit opening of the outer case is the same horizontal surface as that of the lower end surface of one of the side wall plates of the outer case.

2. An adhesive tape adhering device according to claim 1, wherein the pressing roller passes through the tape exit opening by forward swinging operation of the inner case, and projects from the lower end surface of one of the side wall plates.

3. An adhesive tape adhering device according to claim 1, wherein the inner case is provided at its front upper portion with a fingertip engaging portion.

4. An adhesive tape adhering device according to claim 1, wherein the outer case and the inner case are engaged with each other between a stopper disposed on a bottom surface in the outer case and a stopper disposed on a rear upper portion of the inner case side wall by means of a plate spring or coil spring.

5. An adhesive tape adhering device according to claim 1, further comprising a tape core cylinder retaining member which is fixed to a central portion of the side wall plate of the outer case at right angles and which passes through an oval cam hole formed in the inner case, wherein the tape core cylinder retaining member pushes an adhesive tape core cylindrical inner surface by rearward swinging operation of the inner case caused by stress of a spring.

6. An adhesive tape adhering device according to claim 1, further comprising a swinging plate between the inner case side wall and one of the side wall plates, wherein the swinging plate is pivotally mounted to a swinging plate shaft fixed to the inner case side wall above the swinging plate, a pin fixed to a rear portion of the swinging plate shaft above the inner case side wall is engaged with a cam hole formed in the swinging plate, a lateral supporting piece at a lower end of the swinging plate is provided with a cutting blade of the adhesive tape, the swinging plate and the inner case side wall are associatively moved such that the cutting blade is retreated forward of the pressing roller when the inner case is forwardly inclined by longitudinal swinging operation of a fingertip engaging portion, and the cutting blade moves below the lifted pressing roller when the inner case is rearwardly inclined.

7. An adhesive tape adhering device according to claim 1, wherein the outer case has one open end and another end which can be attached and detached.

8. An adhesive tape adhering device comprising an outer case provided at its bottom surface with a tape exit opening, a pair of left and right side wall plates, an inner case mounted such that the inner case can longitudinally swing around an inner case rotation shaft fixed to a lower portion of the outer case, the inner case having a tape mounting shaft to which a roll of adhesive tape can be mounted, and an inner case side wall of the inner case, a pressing roller mounted to a front lower tip end of the inner case side wall at right angles, and a guide roller mounted to the inner case side wall on the side of the adhering surface of the adhesive tape for guiding the adhesive tape sent from the roll of adhesive tape to the pressing roller, wherein there is a small distance between the bottom surface of the outer case and a lower end surface of one of the side wall plates, and wherein the outer case and the inner case are engaged with each other between a stopper disposed on a bottom surface in the outer case and a stopper disposed on a rear upper portion of the inner case side wall by means of a plate spring or coil spring.

9. An adhesive tape adhering device according to claim 8, wherein the pressing roller passes through the tape exit opening by forward swinging operation of the inner case, and projects from the lower end surface of one of the side wall plates.

10. An adhesive tape adhering device according to claim 9, further comprising a swinging plate between the inner case side wall and one of the side wall plates, wherein the swinging plate is pivotally mounted to a swinging plate shaft fixed to the inner case side wall above the swinging plate, a pin fixed to a rear portion of the swinging plate shaft above the inner case side wall is engaged with a cam hole formed in the swinging plate, a lateral supporting piece at a lower end of the swinging plate is provided with a cutting blade of the adhesive tape, the swinging plate and the inner case side wall are associatively moved such that the cutting blade is retreated forward of the pressing roller when the inner case is forwardly inclined by longitudinal swinging operation of a fingertip engaging portion, and the cutting blade moves below the lifted pressing roller when the inner case is rearwardly inclined.

11. An adhesive tape adhering device according to claim 9, wherein the outer case has one open end and another end which can be attached and detached.

12. An adhesive tape adhering device according to claim 8, wherein the inner case is provided at its front upper portion with a fingertip engaging portion.

13. An adhesive tape adhering device according to claim 12, further comprising a swinging plate between the inner case side wall and one of the side wall plates, wherein the swinging plate is pivotally mounted to a swinging plate shaft fixed to the inner case side wall above the swinging plate, a pin fixed to a rear portion of the swinging plate shaft above the inner case side wall is engaged with a cam hole formed in the swinging plate, a lateral supporting piece at a lower end of the swinging plate is provided with a cutting blade of the adhesive tape, the swinging plate and the inner case side wall are associatively moved such that the cutting blade is retreated forward of the pressing roller when the inner case is forwardly inclined by longitudinal swinging operation of a fingertip engaging portion, and the cutting blade moves below the lifted pressing roller when the inner case is rearwardly inclined.

14. An adhesive tape adhering device according to claim 12, wherein the outer case has one open end and another end which can be attached and detached.

15. An adhesive tape adhering device according to claim 8, further comprising a tape core cylinder retaining member which is fixed to a central portion of one of the side wall plates of the outer case at right angles and which passes through an oval cam hole formed in the inner case, wherein the tape core cylinder retaining member pushes an adhesive tape core cylindrical inner surface by rearward swinging operation of the inner case caused by stress of the spring.

16. An adhesive tape adhering device according to claim 8, further comprising a swinging plate between the inner case side wall and one of the side wall plates, wherein the swinging plate is pivotally mounted to a swinging plate shaft fixed to the inner case side wall above the swinging plate, a pin fixed to a rear portion of the swinging plate shaft above the inner case side wall is engaged with a cam hole formed in the swinging plate, a lateral supporting piece at a lower end of the swinging plate is provided with a cutting blade of the adhesive tape, the swinging plate and the inner case side wall are associatively moved such that the cutting blade is retreated forward of the pressing roller when the inner case is forwardly inclined by longitudinal swinging operation of a fingertip engaging portion, and the cutting blade moves below the lifted pressing roller when the inner case is rearwardly inclined.

17. An adhesive tape adhering device according to claim 8, wherein the outer case has one open end and another end which can be attached and detached.

18. An adhesive tape adhering device comprising an outer case provided at its bottom surface with a tape exit opening, a pair of left and right side wall plates, an inner case mounted such that the inner case can longitudinally swing around an inner case rotation shaft fixed to a lower portion of the outer case, the inner case having a tape mounting shaft to which a roll of adhesive tape can be mounted, and an inner case side wall of the inner case, a pressing roller mounted to a front lower tip end of the inner case side wall at right angles, and a guide roller mounted to the inner case side wall on the side of the adhering surface of the adhesive tape for guiding the adhesive tape sent from the roll of adhesive tape to the pressing roller, wherein there is a small distance between the bottom surface of the outer case and a lower end surface of one of the side wall plates, wherein a tape core cylinder retaining member is fixed to a central portion of one of the side wall plates of the outer case at right angles and passes through an oval cam hole formed in the inner case, and wherein the tape core cylinder retaining member pushes an adhesive tape core cylindrical inner surface by rearward swinging operation of the inner case caused by stress of a spring.

19. An adhesive tape adhering device according to claim 18, further comprising a swinging plate between the inner case side wall and one of the side wall plates, wherein the swinging plate is pivotally mounted to a swinging plate shaft fixed to the inner case side wall above the swinging plate, a pin fixed to a rear portion of the swinging plate shaft above the inner case side wall is engaged with a cam hole formed in the swinging plate, a lateral supporting piece at a lower end of the swinging plate is provided with a cutting blade of the adhesive tape, the swinging plate and the inner case side wall are associatively moved such that the cutting blade is retreated forward of the pressing roller when the inner case is forwardly inclined by longitudinal swinging operation of a fingertip engaging portion, and the cutting blade moves below the lifted pressing roller when the inner case is rearwardly inclined.

20. An adhesive tape adhering device according to claim 18, wherein the outer case has one open end and another end which can be attached and detached.

21. An adhesive tape adhering device according to claim 18, wherein the pressing roller passes through the tape exit opening by forward swinging operation of the inner case, and projects from the lower end surface of one of the side wall plates.

22. An adhesive tape adhering device according to claim 21, further comprising a swinging plate between the inner case side wall and one of the side wall plates, wherein the swinging plate is pivotally mounted to a swinging plate shaft fixed to the inner case side wall above the swinging plate, a pin fixed to a rear portion of the swinging plate shaft above the inner case side wall is engaged with a cam hole formed in the swinging plate, a lateral supporting piece at a lower end of the swinging plate is provided with a cutting blade of the adhesive tape, the swinging plate and the inner case side wall are associatively moved such that the cutting blade is retreated forward of the pressing roller when the inner case is forwardly inclined by longitudinal swinging operation of a fingertip engaging portion, and the cutting blade moves below the lifted pressing roller when the inner case is rearwardly inclined.

23. An adhesive tape adhering device according to claim 22, wherein the outer case has one open end and another end which can be attached and detached.

24. An adhesive tape adhering device according to claim 18, wherein the inner case is provided at its front upper portion with a fingertip engaging portion.

25. An adhesive tape adhering device according to claim 24, further comprising a swinging plate between the inner case side wall and one of the side wall plates, wherein the swinging plate is pivotally mounted to a swinging plate shaft fixed to the inner case side wall above the swinging plate, a pin fixed to a rear portion of the swinging plate shaft above the inner case side wall is engaged with a cam hole formed in the swinging plate, a lateral supporting piece at a lower end of the swinging plate is provided with a cutting blade of the adhesive tape, the swinging plate and the inner case side wall are associatively moved such that the cutting blade is retreated forward of the pressing roller when the inner case is forwardly inclined by longitudinal swinging operation of a fingertip engaging portion, and the cutting blade moves below the lifted pressing roller when the inner case is rearwardly inclined.

26. An adhesive tape adhering device according to claim 25, wherein the outer case has one open end and another end which can be attached and detached.

* * * * *